United States Patent [19]

Eisele et al.

[11] 4,003,350

[45] Jan. 18, 1977

[54] FUEL INJECTION SYSTEM

[75] Inventors: Hermann Eisele, Vaihingen; Otto Glöckler, Renningen; Rudolf Schwammle, Korntal, all of Germany

[73] Assignee: Robert Bosch GmbH, Stuttgart, Germany

[22] Filed: Sept. 18, 1975

[21] Appl. No.: 614,768

[30] Foreign Application Priority Data

Oct. 10, 1974 Germany ..... 2448306

[52] U.S. Cl. ..... 123/32 EA; 60/276

[51] Int. Cl.[2] ..... F02B 3/00

[58] Field of Search ..... 123/32 EA; 60/276, 285

[56] References Cited

UNITED STATES PATENTS 3,874,171 4/1975 Schmidt ..... 123/32 EA 3,939,654 2/1976 Creps ..... 60/276

*Primary Examiner*—Ronald B. Cox

*Attorney, Agent, or Firm*—Edwin E. Greigg

[57] ABSTRACT

A fuel injection system for an internal combustion engine having integral action regulation for influencing the fuel-air mixture supplied to the engine includes an exhaust gas oxygen sensing probe, two regulating stages, and an electronic control unit all connected in circuit to provide a signal to the fuel injection valves directly or to an electromagnetic pressure control valve in the circuit of the fuel injection valves for varying the fuel quantity injected and consequently the fuel-air mixture to the engine.

7 Claims, 2 Drawing Figures

FUEL INJECTION SYSTEM

BACKGROUND OF THE INVENTION

The present invention relates to a fuel injection system for internal combustion engines having integral action regulation for influencing the fuel-air mixture supplied to the engine by means of an oxygen probe disposed in the exhaust gas conduit ($\lambda$ regulation).

When the mass ratio of the fuel-air mixture supplied to the internal combustion engine is to be influenced as a function of the composition of the exhaust gas, this is generally accomplished by means of an oxygen probe disposed in the exhaust gas flow of the engine and a regulating device which produces a corresponding increase or reduction in the respective quantity of fuel metered in proportion to the quantity of air in dependence on the output signal of the oxygen probe. It is known that this method of varying the fuel-air mixture can be implemented both in the case of engines equipped with carburetors and also in the case of engines equipped with fuel injection systems.

The regulating devices used to influence the mass ratio of the fuel-air mixture supplied to the engine are preferably integral action regulators and thus, when the exhaust gas composition deviates for a prolonged period from a nominal value, increasing correction of the mass ratio of the fuel-air mixture will take place.

In the case of the known fuel injection systems of this type regulation of the air number is provided at $\lambda = 1$. The regulating range of the regulation devices used to influence the mass ratio of the fuel-air mixture must be kept relatively low to avoid interruptions in the performance of the engine at the requisite high regulating rates. If larger tolerances are produced in the engine or in the processing systems as a result of aging, or if marked changes are produced in the operating conditions of the engine, for example, as a result of variations in the temperature or pressure of the air drawn in, it is not possible to compensate for these variations in the case of the known fuel injection systems without considerable expenditure on construction.

OBJECT AND SUMMARY OF THE INVENTION

It is, therefore, a principal object of the present invention to provide a fuel injection system of the known type which enables the afore-mentioned tolerances and variations to be compensated.

The principal object is achieved according to the present invention in that the control voltage of the oxygen probe is supplied to a first regulating stage, the output of which is connected to the input of a second regulating stage. The output signal of the second regulating stage is superimposed on the output signal of the first regulating stage and supplied to an electronic control device which influences an adjusting member varying the fuel-air mixture. The regulating range and regulating time constant of the first regulating stage are relatively low compared to the regulating range and time constant of the second regulating stage.

An advantageous feature of the present invention consists in that the nominal voltage of the second regulating stage is half the amount of the maximum output voltage of the first regulating stage, and the regulating range and regulating time constants of the first regulating stage are adapted to the engine operating conditions.

Another advantageous feature of the present invention consists in that the nominal voltage at the input of the first regulating stage is variable as a function of the operating parameters of the internal combustion engine.

According to another advantageous feature of the present invention, an additional voltage is superimposable on the output voltage of the second regulating stage for influencing the fuel-air mixture as a function of the operating parameters of the internal combustion engine. This additional voltage can be supplied via a switch.

Two embodiments of the invention are represented in simplified form in the drawings and will be described in greater detail hereinafter.

DESCRIPTION OF THE PREFERRED EMBODIMENTS

Figure 1:
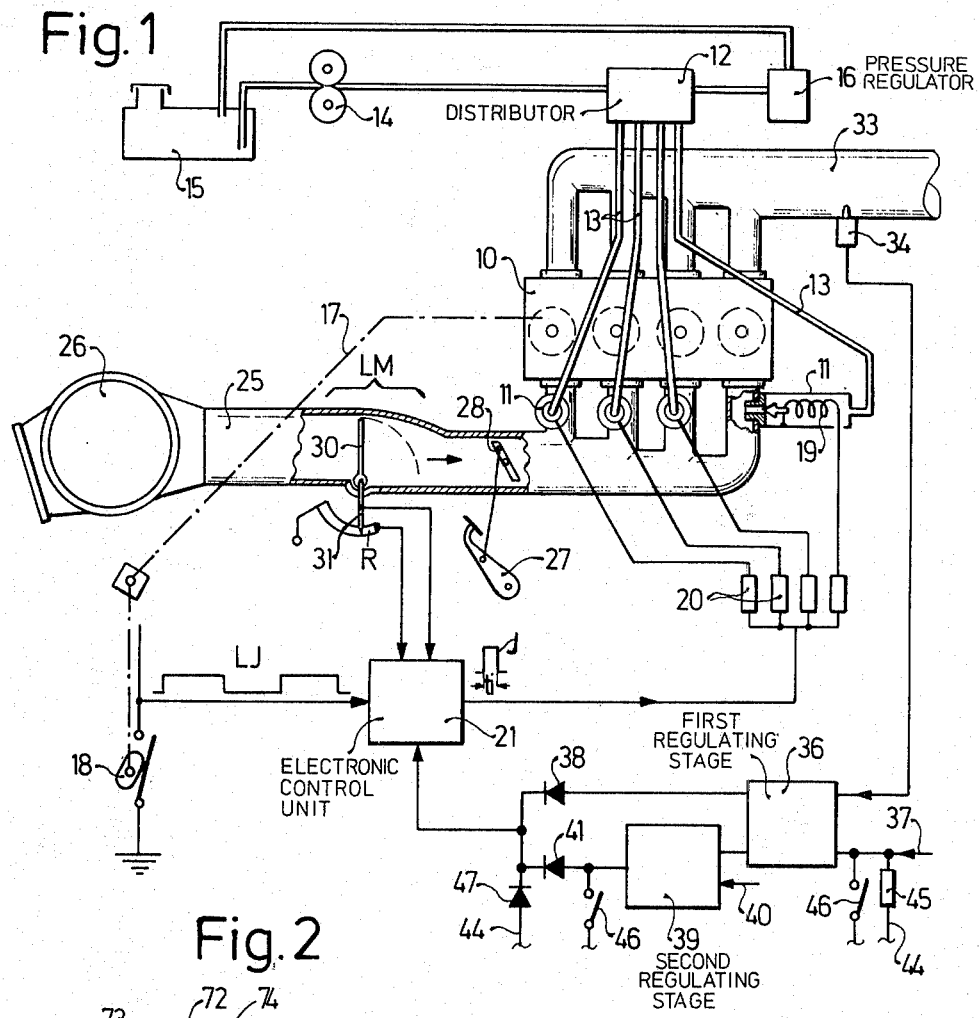
FIG. 1 illustrates a generalized schematic diagram of an internal combustion engine and an electrically controlled fuel injection system for the engine with a schematic diagram of its regulating device.

The electrically controlled fuel injection system illustrated in FIG. 1 is intended for operation with a four-cylinder four-cycle internal combustion engine 10. This fuel injection system comprises, as its most essential components, four electromagnetically operable fuel injection valves 11 to which the fuel to be injected is supplied from a distributor 12 via individual fuel lines 13, an electrically driven fuel supply pump 14, which supplies fuel from a fuel tank 15, a pressure regulator 16 which controls the fuel pressure to a predetermined constant value, and an electronic control and regulating unit which will be described in more detail hereinafter. The electronic control and regulating unit is triggered twice during each rotation of the engine cam shaft 17 by means of a signal generator 18 operatively coupled to the cam shaft and thus delivers a rectangular electrical opening pulse J for each of the injection valves 11. The pulse width $t_i$ of the opening pulse shown in the drawing determines the opening time of the injection valves 11 and accordingly, the quantity of fuel which leaves the inner chamber of the injection valves 11 during its respective opening period; the injection valves 11 being under a virtually constant fuel pressure of 2 bars. Each of the injection valves 11 has a magnetic winding 19, and each magnetic winding 19 is connected in series with a decoupling resistor 20 to a common amplifying and power stage of an electronic control unit 21. The electronic control unit 21 contains at least one power transistor, the emitter-collector path of which is connected in series with the decoupling resistors 20, and hence, with the magnetic windings 19, whose other end is grounded.

In the operation of mixture-compressing and externally ignited internal combustion engines of this type, the fuel quantity provided to a particular cylinder during each piston suction stroke in accordance with the quantity of air drawn in is such that it can be completely combusted during the subsequent power stroke. To ensure that the internal combustion engine is used efficiently it is absolutely essential that no substantial quantity of air remains in the cylinder after the power stroke. To provide the desired stoichiometric ratio of aspirated air and fuel, an air flow rate meter LM is provided in the suction tube 25 of the internal combustion engine. The air flow rate meter LM is located downstream of an air filter 26 but upstream of a throttle butterfly valve 28 of the engine. The butterfly valve 28 is adjustable by means of gas pedal 27. The air flow rate meter LM consists essentially of a baffle plate 30 and a variable potentiometer R, the adjustable tap 31 of which is coupled to the baffle plate. The electrical output of the air flow rate meter LM is fed to the electronic control unit 21 whose own output supplies the injection pulses of width $t_i$.

The electronic control unit 21 is known, for example, from U.S. Pat. No. 3,750,631, and includes two transistors in push-pull operation and connected in mutual feedback configuration and is also includes an energy storage device which may be a capacitor or an inductor. The duration of the discharging process of the energy storage device determines the opening duration $t_i$ for the injection valves. For this purpose, the energy storage device must be charged in an appropriate manner prior to each discharging process operation.

The charging process of the energy storage device is accomplished by a switch, embodied in this example by a signal transmitter 18 which is actuated in synchronism with the crankshaft rotation, which provides that the energy storage device is connected to a source of electric charge during a predetermined, constant angular motion of the crankshaft. The switch 18 thus provides a charging pulse LJ which makes available a charging current during this time. At the same time, the control unit 21 receives information regarding the air quantity admitted through the suction tube of the engine during this interval. In the present case, let it be assumed that the signal generator 18, which may also be embodied in a practical situation by a bi-stable multivibrator clocked by ignition pulses, is closed over a crankshaft angle of 180° and is then opened over the remaining angle of 180°.

In that case, it is possible to achieve as nearly exact a regulation of the air number λ as desired by providing an oxygen sensor 34 in the exhaust gas pipe 33 of the engine 10. The oxygen sensor 34 delivers a control voltage as a function of the exhaust gas composition, and this voltage is fed to the input of a first regulating stage 36. The first regulating stage 36 is provided with a presettable nominal voltage via the line 37, with the nominal voltage being independent of the battery voltage of the vehicle. The output of the first regulating stage 36 is coupled through a diode 38 to the electronic control unit 21 and also to the input of a second regulating stage 39. A nominal voltage is applied to the second regulating stage 39 via the line 40. This nominal voltage consists of substantially half the value of the maximum output voltage of the first regulating stage 36. The output signal of the second regulating stage 39 is superimposed on the output signal of the first regulating stage by a diode 41 and supplied to the electronic control unit 21.

The first regulating stage 36 and the second regulating stage 39 each contain a comparator and an integrator. The first regulating stage 36 is designed in such a way that, by comparison with the second regulating stage 39, it comprises a small regulating range and a low regulating time constant for compensating dynamic errors, that is errors which result from operation of the engine; whereas the second regulating stage 39 operates with a broad regulating range and high time constant for compensation of the tolerances and drift phenomena due to mass production and wear.

The first regulating stage 36 and the second regulating stage 39 are known, for example, from U.S. Pat. No. 3 874 171.

It is possible to lean-out or enrich the fuel-air mixture, for example, during acceleration, or idling, or overrunning operation by varying the nominal value of the first regulating stage 36; or by acting on the output of the second regulating stage 39. These superpositions of the additional voltages can be effected by means of a line 44 and a resistor 45, or a diode 47, or a switch 46, which can be a butterfly valve switch, for example.

Figure 2:
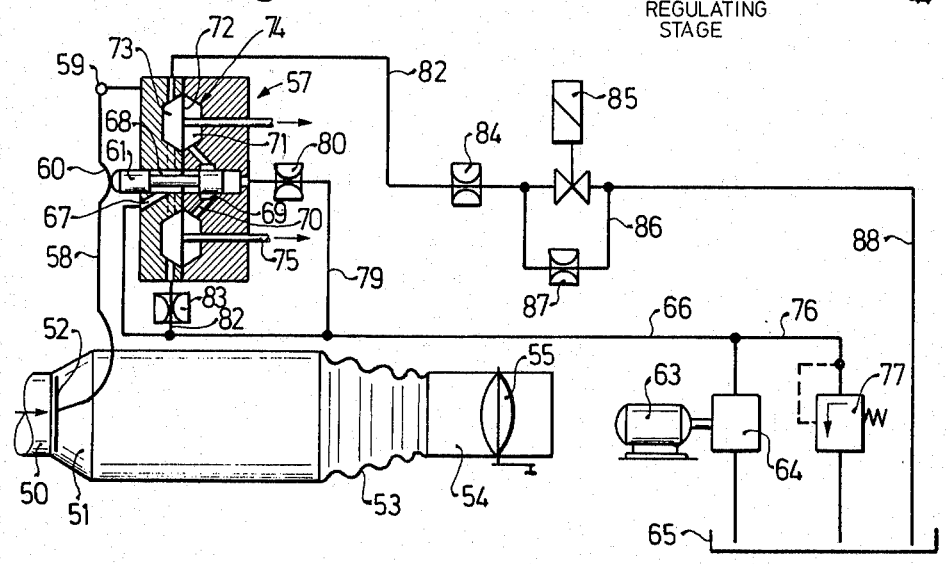
FIG. 2 illustrates a mechanical fuel injection system partly in cross section according to which the fuel-air mixture is electromagnetically influenced.

FIG. 2 illustrates a mechanically controlled fuel injection system for the purpose of influencing the fuel-air mixture. In this embodiment the combustion air flows in the direction of the arrow into a suction tube 50. The suction tube 50 comprises a conical portion 51 having an air sensing element 52 disposed therein. The air flows through a coupling hose 53 and a suction tube portion 54, in which there is mounted an arbitrarily operable throttle butterfly valve 55, to one or more cylinders (not shown) of the internal combustion engine. The air sensing element 52 consists of a plate disposed at right angles to the direction of air flow which is moved in the conical suction tube portion 51 as an approximately linear function of the air flowing through the suction tube. Given a constant restoring force exerted on the air sensing element 52 as well as a constant pressure prevailing upstream of the air sensing element 52 the pressure prevailing between the air sensing element 52 and the butterfly valve 55 also remains constant.

The air sensing element 52 directly controls a fuel metering and distributing valve 57. For transmitting the motion of the air sensing element 52 there is provided a lever 58 which is connected to the air sensing element and which is pivotably mounted about a pivot point 59. The lever 58 is provided with a nose 60 and during the pivoting movement of the lever the nose 60 actuates the movable control plunger 61 of the fuel metering and distributing valve 57.

The fuel is supplied from a fuel tank 65 by a fuel pump 64 driven by an electromotor 63 and is delivered through a conduit 66 and a channel 67 into the annular groove 68 of the control plunger 61. Depending on the position of the control plunger 61 the annular groove 68 covers to a greater or lesser extent the control slots 69 which lead through channels 70 to chambers 71. Each of the latter is separated from a chamber 73 by a membrane 72. The membrane 72 serves as the movable part of a flat seat valve in the form of a pressure equalizing valve 74. From the chambers 71 the fuel is admitted through injection channels 75 to the individual fuel injection valves (not shown) which are disposed in the suction tube in the vicinity of their respective engine cylinder.

From the conduit 66 there extends a conduit 76 in which is connected a pressure limiting valve 77 which enables the fuel to return to the fuel tank 65 when the pressure in the system is excessive.

Pressurized liquid acts on the front face of the plunger 61 disposed opposite the lever 58. This pressurized liquid serves to exert the restoring force for the air sensing element 52 and passes from the conduit 66 through the conduit 79 and a damping throttle 80 into the fuel metering and distributing valve 57.

From the conduit 66 there extends a pressure control conduit 82 in which are disposed in series an uncoupling throttle 83, the chambers 73 of the pressure equalizing valve 74, a throttle 84 and a magnetic valve 85. A throttle 87 is disposed parallel to the magnetic valve 85 in a line 86. By means of the throttle 87 fuel from the pressure control conduit 82 can flow back to the fuel tank 65 without pressure via a return line 88.

The fuel injection system illustrated in FIG. 2 operates in the following manner:

When the internal combustion engine is running, air is drawn in via the suction tube 50, 53 and 54 and, as a result, the air sensing element 52 undergoes a certain excursion from its rest position. In response to the deflection of the air sensing element 52 the control plunger 61 of the fuel metering and distributing valve 57 is displaced via the lever 58. The direct connection between the air sensing element 52 and the control plunger 61 ensures a constant ratio between the quantity of air and the metered quantity of fuel.

To be able to enrich or lean-out the fuel-air mixture according to the region of the operating range of the engine, it is necessary to vary the quantity of suction air in proportion to the metered quantity of fuel as a function of the operating parameters of the engine. On the one hand, the fuel-air mixture can be varied by varying the restoring force exerted on the air sensing element 52 and, on the other hand, by varying the pressure differential at the metering valves 68, 69. In the case of internal combustion engines having a plurality of engine cylinders it is advantageous for the valves 74 in the fuel metering and distributing valve 57 to be in the form of pressure equalizing valves. The differential pressure at the metering valves 68, 69 can be jointly regulated and varied in an advantageous manner by the pressure in the pressure control conduit 82. In the case of the present embodiment the pressure difference at the metering valves 68, 69 is varied by varying the differential pressure at the uncoupling throttle 83, thereby varying the quantity of liquid flowing through the uncoupling throttle. The quantity of liquid flowing through the uncoupling throttle 83 is variable by virtue of the fact that connected in series with the throttle 83 is a throttle 84 and a magnetic valve 85 with a throttle 87 disposed parallel therewith in the pressure control conduit 82. When the magnetic valve 85 is closed the quantity of fuel flowing through the uncoupling throttle 83 is determined by the throttles 83, 84 and 87. When the magnetic valve 85 is open the fuel flowing in the pressure control conduit 82 is only determined by the throttles 83 and 84 which results in a reduced throttling action and an increased pressure difference at the uncoupling throttle 83 which also results in an increase in the pressure difference at the metering valves 68 and 69. The differential pressure at the uncoupling throttle 83 can be varied by varying the opening period of the magnetic valve 85 relative to its closing period. As a result, with a permanently closed magnetic valve there is obtained a minimal pressure difference and a lean fuel-air mixture whereas with a permanently open magnetic valve 85 the maximum pressure difference and the richest fuel-air mixture are obtained.

Any requisite damping of the pressure jumps can be effected by a storage element (not shown) in the control pressure conduit.

The operative duration of the electromagnetic valve 85 can also be varied by an electronic control device (not shown) in the manner indicated in FIG. 1. That is, the output of the electronic control unit 21 may be connected to the valve 85 instead of to the valves 11. This electronic control device may be supplied with both the operating parameters of the engine determined by pick-up elements and also with output signals of the first and second regulating stages which are connected in the form of a cascade and controlled by an oxygen probe.

A significant advantage provided by a fuel injection system constructed according to the present invention and comprising two regulating stages connected in cascade is that it is now possible to increase the overall regulating range of the regulating system in order to compensate for mass production tolerances and dimensional variations in the internal combustion engine and the auxiliary engine systems which result from usage. Another significant advantage resides in the elimination of the necessity for altitude and air density compensation and in the equalization of measuring errors in the air flow rate regulating system. By designing the first regulating stage with a small regulating range and low time constant the regulating results can be better adapted to the dynamic driving conditions.

What is claimed is:

1. In a fuel injection system for an internal combustion engine having integral action regulation for influencing the fuel-air mixture supplied to the engine, and an oxygen sensor disposed in the exhaust gas flow from the engine and producing an output voltage indicative of the oxygen content of the exhaust gas, the improvement comprising:

a. a first regulating stage to which a nominal voltage is applied, said first regulating stage being connected to the oxygen sensor for receiving the output voltage of the oxygen sensor, and for producing an output voltage which is a function of both the nominal voltage and the output voltage of the oxygen sensor;

b. a second regulating stage to which a nominal voltage is applied, said second regulating stage being connected to the first regulating stage for receiving the output voltage of the first regulating stage, and for producing an output voltage which is a function of both the nominal voltage applied to the second regulating stage and the output voltage of the first regulating stage;

c. means for superimposing the output voltages of the first and second regulating stages;

d. an electronic control unit connected to the means for superimposing the output voltages of the first and second regulating stages for receiving the superimposed voltages as an input; and e. adjustable means connected to the electronic control unit for receiving the output voltage from the electronic control unit and varying thereby the fuel quantity injected and consequently the fuel-air mixture, wherein the regulating range and regulating time constant of the first regulating stage is lower than the regulating range and regulating time constant of the second regulating stage.

2. The fuel injection system as defined in claim 1, wherein the nominal voltage of the second regulating stage is approximately one-half the value of the maximum output voltage of the first regulating stage.

3. The fuel injection system as defined in claim 1, wherein the regulating range and regulating time constant of the first regulating stage are adapted to the engine conditions.

4. The fuel injection system as defined in claim 1, wherein the improvement further comprises means for varying the nominal voltage applied to the first regulating stage as a function of the operating parameters of the engine.

5. The fuel injection system as defined in claim 4, wherein the means for varying the nominal voltage includes a switch.

6. The fuel injection system as defined in claim 1, wherein the improvement further comprises means for superimposing an additional voltage on the output voltage of the second regulating stage for influencing the fuel-air mixture as a function of the operating parameters of the engine.

7. The fuel injection system as defined in claim 6, wherein the means for superimposing includes a switch.

* * * * *